US005582108A

United States Patent [19]

Benenowski et al.

[11] Patent Number: 5,582,108

[45] Date of Patent: Dec. 10, 1996

[54] RAIL JUNCTION

[75] Inventors: Sebastian Benenowski, Butzbach; Erich Nuding, Aalen, both of Germany

[73] Assignee: BWG Butzbacher Weichenbau GmbH, Butzbach, Germany

[21] Appl. No.: 442,421

[22] Filed: May 16, 1995

[30] Foreign Application Priority Data

May 16, 1994 [DE] Germany ..... 44 16 819.5

[51] Int. Cl.[6] ..... E01B 7/00

[52] U.S. Cl. ..... 104/130.11

[58] Field of Search ..... 104/130.03, 130.11

[56] References Cited

U.S. PATENT DOCUMENTS 3,855,938 12/1974 Peveraro ..... 104/130.11
3,872,793 3/1975 Patin ..... 104/130.11

FOREIGN PATENT DOCUMENTS 1739034 2/1956 Germany .
7035954 5/1972 Germany .
2304958 10/1977 Germany .
1378116 12/1974 United Kingdom .

OTHER PUBLICATIONS

Kindmann, et al: Stahliegeweiche mit hydraulischem Antrieb für die Transrapid Versuchsanlage Emsland—Bauingenieur No. 63, 1988 pp. 551–556.

*Primary Examiner*—S. Joseph Morano
*Attorney, Agent, or Firm*—Dennison, Meserole, Pollack & Scheiner

[57] ABSTRACT

A rail junction (20) between rail lines (12, 14) extending in a direction parallel to each other for a car with a predetermined clear space profile, for a dual-track line of a high-speed magnetic train. Rail line (12) consists of line up supports (22, 24) and flexible support (16), rail line (14)consists of supports (28, 26) and flexible support (18), the flexible supports (16, 18) are elastically bent so that their ends (30, 32) are aligned for providing a rail connection. In order to permit a track change without changing the distance between the rail lines, the support (22, 26) adjoining the elastically bendable end (30, 32) of the bendable support (16, 18) is elastically bent outward away from the direction of the rails.

6 Claims, 2 Drawing Sheets

RAIL JUNCTION

FIELD OF THE INVENTION

The invention relates to a junction in a dual-track rail line for a high-speed magnetic train with cars of a predetermined clear space profile. The junction comprises two rail lines extending parallel to each other, each one of which consists of supports adjoining each other. In the area of the junction a flexible support of each rail line is resiliently bendable in the direction of the other rail line for an aligned orientation, and the rail lines are embodied without gaps to the greatest extent possible in the area where they run parallel as well as in the area of the junction.

BACKGROUND OF THE INVENTION

The individual rail lines of a high-speed magnetic train consist of individual supports of steel or concrete which are lined up with each other and can extend on the level ground or on girders.

Flexible steel switches consisting of continuous steel supports are used to reroute a car from one rail line or track to the other, and these can be resiliently bent and aligned with each other with the aid of an electro-magnetic actuating drive for the connection of the tracks or the junction.

For space-saving reasons the distance between the individual rail lines is selected to be such that it is less than twice the clear space profile of the cars floating along the rail.

Because of this, it is necessary for the rail lines to be guided away from each other, i.e the dual-track rail line undergoes a widening, in the area of the junction. Such a widening has the disadvantage, for example, that the speed of a car needs to be reduced and/or there are greater space requirements for the junction. A more elaborate line layout is also required.

A wheel-rail system for cars with pneumatic-tired wheels is known from German Patent Publication DE 23 04 958 B2, wherein sections of rail are embodied to be pivotable in the area of a switch. For this reason it is absolutely necessary for the rails to have gaps in the transition area.

Conventional tongue devices which are not designed for magnetic levitation trains are described in British Patent Publication GB 1 378 116 and German Patent Publication DE 7 035 954.

Switches which, in accordance with German Patent Publication DE 1 739 034 and with a publication by Kindmann, R., Schwindt, G.: "Stahlbiegeweiche mir hydraulischem Antrieb für die Transrapid Versuchsanlage Emsland" [Flexible Steel Switch with Hydraulic Actuation for the Emsland Transrapid Test] published in Bauingenieur [Civil Engineer] 63, 1988, pp. 551 to 556, FIGS. 1 and 2, are intended for monorail trains. They employ bendable or flexible supports in the transition area.

OBJECT AND SUMMARY OF THE INVENTION

It is the object of the invention to provide a track junction of the type mentioned at the outset, by means of which no change in the course of the rail line in the area of the rail junction is required, even if the distance between the rail lines is less than twice the clear space profile of the cars moving over the rail line.

This object is attained in accordance with the invention in that the support adjoining the elastically bendable end of the bendable support can be elastically bent outward away from the adjoining rail line.

In accordance with the invention it is assured that even when a car moves through the rail junction, i.e. changes the track, the distance from the support of the respective rail line is at least equal to, and preferably slightly greater than the clear space profile of the car. Based on this it is no longer required that the supports of the respective rail line be moved away from each other in the area of the junction—i.e. the rail connection—that is ahead of and behind it in order to obtain the widening required in accordance with the prior art, which is mandatory in those cases where the clear distance between the rail lines running parallel with each other is less than twice the clear space profile of the car moving on the rail lines; otherwise the cars of the high-speed magnetic train, which laterally embrace the supports, would bump into the supports of the adjoining rail line.

Further details, advantages and characteristics of the invention ensue not only from the claims, the characteristics found therein—either by themselves or in combination—, but also from the following description of a preferred embodiment to be taken from the drawings.

DETAILED DESCRIPTION OF THE PREFERRED EMBODIMENT

The support and guidance system of a high-speed magnetic train operates in accordance with the electromagnetic levitation principle. It is based on the attractive forces between individual electromagnets disposed in the floor section of the car and the ferromagnetic reaction rails installed below the rail line. In the course of this the support magnets pull the car from below against the rail line and the guide magnets maintain it laterally on the track. The support and guide magnets are disposed on both sides along the entire length of the car. Based on this support and guidance system, the cars of a high-speed magnetic train laterally embrace the rail line.

The rail line itself is formed from lined-up supports of steel or concrete which can be disposed on level ground or above ground, on girders.

Figure 1:
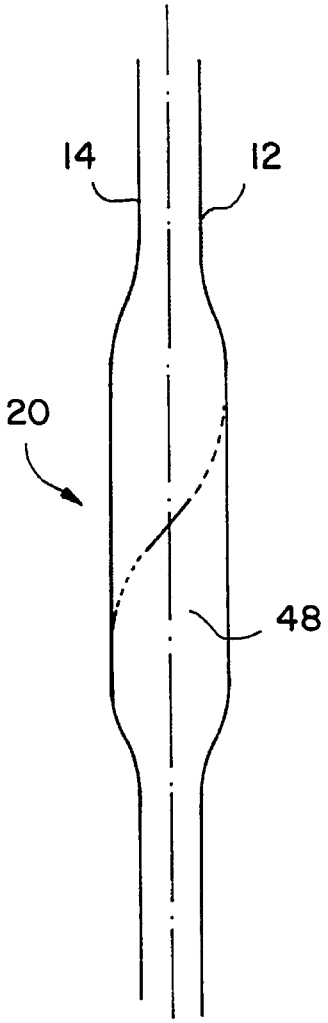
FIG. 1 PRIOR ART
FIG. 1 is a basic representation of a rail junction of a dual-track rail line for a high-speed magnetic train in accordance with the prior art.
Figure 2:
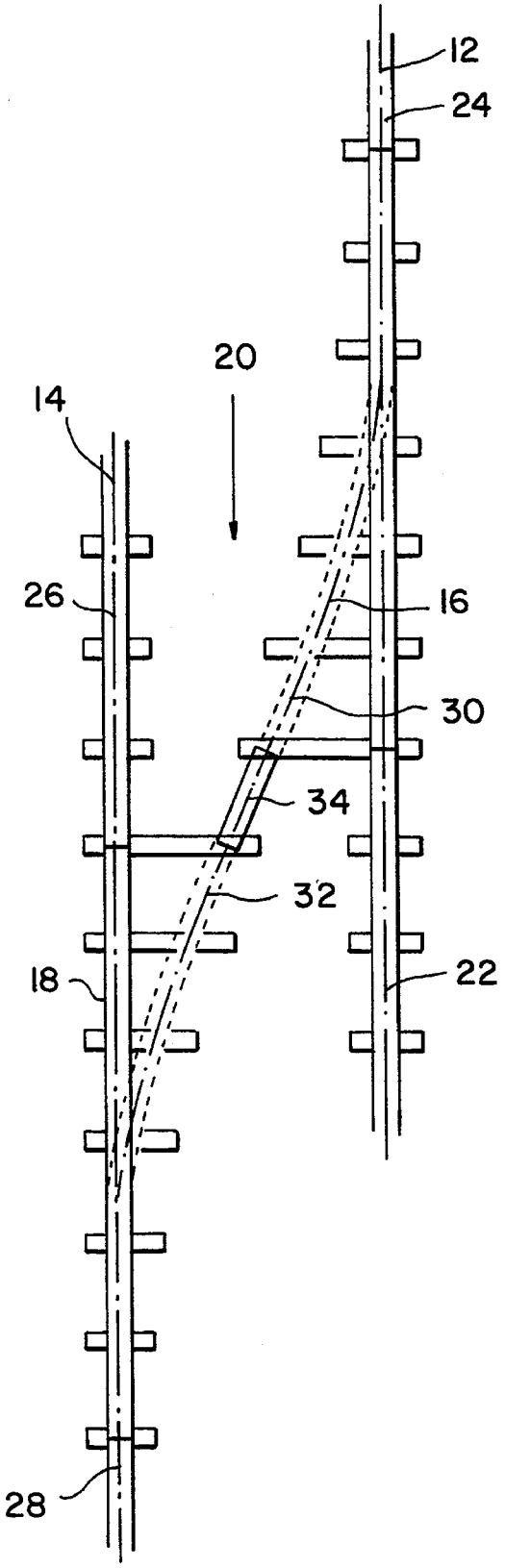
FIG. 2 PRIOR ART
FIG. 2 shows details of the rail junction of FIG. 1.

A prior art dual-track rail line, comprising the rail lines (12) and (14), is shown basically in FIG. 1. Each rail line (12) and (14) consists of lined up supports, above which the cars float at a constant distance by means of the previously described mode of functioning.

Flexible steel switches are employed to allow a track change from the one rail line (12) to the other, or vice versa, which consist of continuous steel supports (16) and (18), which are elastically bent to form a rail connection or junction (20), i.e. to achieve the track change, with the aid of an electromechanical actuation drive.

Stationary supports (22), (24), (26) and (28) adjoin the supports (16) and (18), which are to be identified as flexible supports and form the junction.

With the flexible supports (16) and (18) facing each other, a gap is formed between their ends (30) and (32). This gap is bridged by an intermediate element (34), which is inserted in a known manner or it is present in the rail line of the junction (20).

With conventional dual-track rail lines the clear distance between the individual rail lines (12) and (14) is less than twice the clear space profile of the cars floating along the rail lines (12) and (14). Because of this it is necessary that the rail lines (12) and (14) undergo a widening i.e. additional separation, which is shown (48) in FIG. 1. In other words, the distance between the rail lines (12) and (14) must be increased in the area of the junction (20) to assure that there is no collision between a car and the stationary supports of the rail lines (12) and (14) when traveling through the junction (20).

Figure 3:
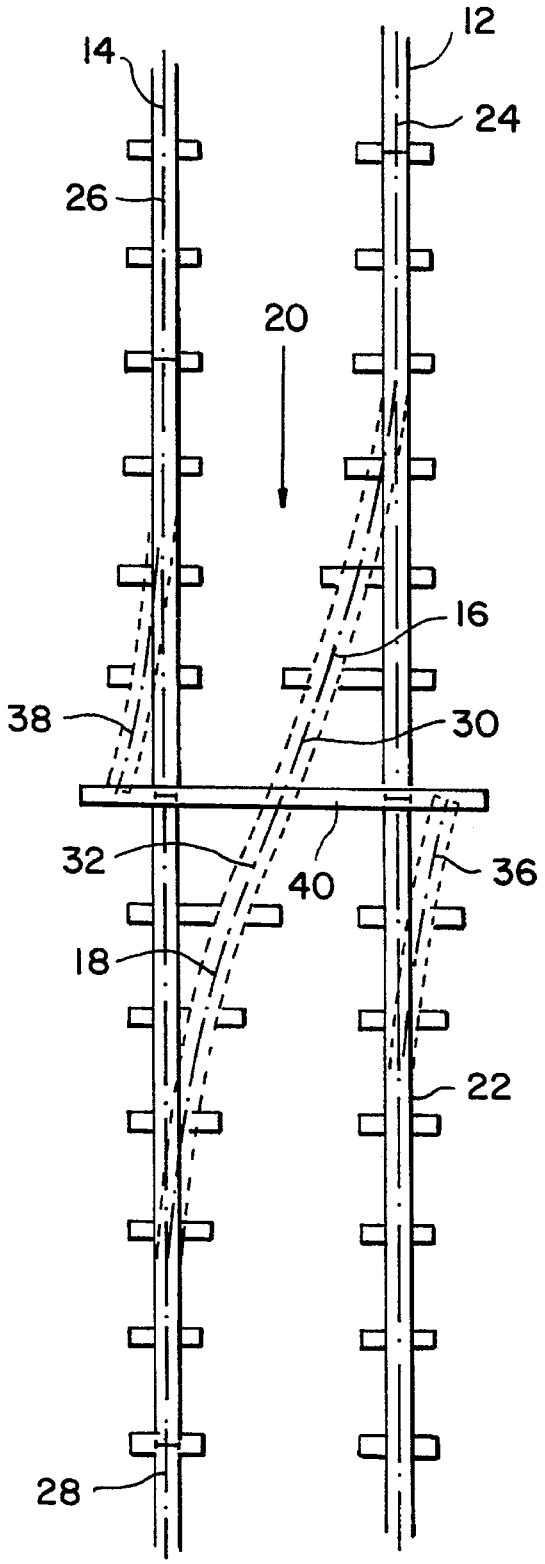
FIG. 3 shows details of a rail junction for the dual-track rail line designed in accordance with the invention.

In accordance with the invention shown in FIG. 3, it has now been provided that the rail lines (12) and (14) continue to be at the same distance which is customary maintained ahead of and behind the junction (20). For space-saving reasons this is less than twice the clear space profile of the car. With existing high-speed magnetic trains the clear space profile can be 3.65 m and the clear distance between the rail lines (12) and (14) 5.10 m.

Regardless of this reduced distance between the rail lines (12) and 14), however, it is assured by the teaching of the invention that a car can travel through the junction without the supports (22) and (26), which adjoin the flexible supports (16), (18), constituting an obstacle.

To accomplish this, the end portions (36) and (38) of the supports (22) and (26) which adjoin the ends (30) and (32) of the flexible supports (16), (18) are also flexibly bendable, namely toward the outside, i.e. away from the adjoining rail lines (14) and (12), and thus away from the junction (20). This results in a distance between the flexible supports (16) and (18) facing each other and the adjoining supports (22), (26) in the area of the junction (20), so that unhampered travel through the junction (20) is possible.

Because the distance between the rail lines (12) and (14) in the area of the junction is short compared with the prior art, a further advantage ensues, that is the length of the junction (20) can be kept relatively short. Therefore the time during which the speed of the car must be reduced while traveling through the junction is shortened. It is also possible to integrate the rail junction in accordance with the invention in a simple way into existing line layouts.

To make a simple displacement of the free ends (30) and (32) of the flexible supports (16) and (18) as well as the ends (36) and (38) of the outwardly elastically bendable supports (22) and (26) possible, the ends (30), (32), (36) and (38) can be supported on a common continuous girder (40) and displaced on it. This results in further structural simplification, since in accordance with the prior art is is necessary to support the ends of the flexible supports on different girders because of the increased distance between the rail lines.

What is claimed is:

1. In a dual-track railway of a high speed magnetic train for cars of a predetermined clear space profile, a junction (20) for enabling a train to change tracks, said junction comprising:

a first rail line (12), a second rail line (14), said first and second rail lines extending in one direction and parallel to each other, said first rail line including first and second supports and said second rail line including third and fourth supports, flexible supports (16, 18) extending from the second and fourth supports (24), (28), with second and fourth end portions (30), (32), respectively, said first and third supports (22), (26) having first and third bendable end portions (36), (38), said first and third, second and fourth end portions are aligned for enabling cars to travel without track change, the first and third end portions (36, 38) are bendable outward, away from the direction of the rails and the second and fourth end portions (30, 32) are bendable inward to be aligned for enabling cars to change tracks without the first and third support ends (36, 38) causing obstacles to the track change.

2. The junction according to claim 1, including a common carrier (40) for supporting the end portions (30, 32, 36, 38).

3. A dual-track railway junction (20) for a high-speed magnetic train of cars of a predetermined clear space profile, comprising: two rail lines (12, 14) extending in a direction parallel to each other, one of which includes first and second supports (22, 24), the other includes third and fourth supports (26, 28), aligned and adjoined with each other in the area of the junction, a pair of flexible supports (16, 18) one for each rail line being resiliently bendable in the direction of the other rail line for enabling an aligned orientation and, a first elastically bendable portion adjoining the first support (22) having an end (36), a second elastically bendable portion adjoining the third support (26) having an end (38), and each said end (36, 38) being bendable outward and away from the direction of the rail lines.

4. A dual-track railway junction in accordance with claim 3, wherein the rail lines (12, 14) run parallel and without a widening through the area of the rail junction.

5. A dual-track railway junction in accordance with claim 3 wherein ends (30, 32) of the flexible supports (16, 18) and the ends (36, 38) of the first and second elastically bendable portion are supported on a common girder (40).

6. A dual-track railway junction in accordance with claim 3, wherein the distance between the rail lines (12, 14) is adapted to be less than twice the clear space profile of a car, said first and second support of one rail line and said third and fourth support of the other rail line are disposed and extend along a common straight line, the ends (36, 38) of the first and second elastically bendable portions are bent outward, the flexible supports (16, 18) of the respective rail line (12, 14), which constitute the rail junction (20) are aligned with each other, and there is a distance which is adapted to be at least equal to the clear space profile of a car so that a car can travel through the junction.

* * * * *